US011443913B2

(12) United States Patent
Fritzler

(10) Patent No.: US 11,443,913 B2
(45) Date of Patent: Sep. 13, 2022

(54) X-RAY RADIATOR

(71) Applicant: Siemens Healthcare GmbH, Erlangen (DE)

(72) Inventor: Anja Fritzler, Erlangen (DE)

(73) Assignee: Siemens Healthcare GmbH, Erlangen (DE)

( * ) Notice: Subject to any disclaimer, the term of this patent is extended or adjusted under 35 U.S.C. 154(b) by 0 days.

(21) Appl. No.: 17/330,978

(22) Filed: May 26, 2021

(65) Prior Publication Data

US 2021/0383997 A1 Dec. 9, 2021

(30) Foreign Application Priority Data

Jun. 3, 2020 (DE) ..... 10 2020 206 939.5

(51) Int. Cl.
*H01J 35/06* (2006.01)
*H01J 35/14* (2006.01)
(Continued)

(52) U.S. Cl.
CPC ..... *H01J 35/064* (2019.05); *H01J 35/101* (2013.01); *H01J 35/153* (2019.05); *H05G 1/52* (2013.01);
(Continued)

(58) Field of Classification Search
CPC ..... H01J 35/064; H01J 35/065; H01J 35/101; H01J 35/153; H01J 2235/068; H01J 2235/162; H05G 1/52; H05G 1/70
See application file for complete search history.

(56) References Cited

U.S. PATENT DOCUMENTS 5,274,690 A * 12/1993 Burke ..... H05G 1/66 378/135
5,550,890 A * 8/1996 Anderson ..... H01J 35/24 378/136
(Continued)

FOREIGN PATENT DOCUMENTS

DE 102012209089 A1 12/2013
DE 102016215375 A1 2/2018

OTHER PUBLICATIONS

German Office Action and English translation thereof dated Mar. 29, 2021.
(Continued)

*Primary Examiner* — Chih-Cheng Kao
(74) *Attorney, Agent, or Firm* — Harness, Dickey & Pierce, P.L.C.

(57) ABSTRACT

An X-ray radiator and an X-ray assembly are disclosed. The X-ray radiator according to an embodiment has an evacuated X-ray tube housing, mounted to be rotatable about a rotation axis, the X-ray tube housing including an anode and an electron source. The anode is arranged within the X-ray tube housing non-rotatably relative to the X-ray tube housing and is configured to generate X-ray radiation via electrons impacting upon a focal spot of the anode, the electron source being mounted substantially stationary within the X-ray tube housing relative to the rotation axis. The electron source has a main emitter and at least one subsidiary emitter for emitting electrons. The electron emission of the main emitter and/or of the at least one subsidiary emitter is controllable such that a spatial movement of the focal spot due to a movement of the electron source is reduced.

14 Claims, 5 Drawing Sheets

(51) Int. Cl.
*H01J 35/10* (2006.01)
*H05G 1/52* (2006.01)

(52) U.S. Cl.
CPC ..... *H01J 35/065* (2013.01); *H01J 2235/068* (2013.01); *H01J 2235/162* (2013.01)

(56) References Cited

U.S. PATENT DOCUMENTS

| | | | | |
|---|---|---|---|---|
| 2005/0094762 | A1* | 5/2005 | Dunham | H05G 1/52 378/19 |
| 2008/0267354 | A1* | 10/2008 | Holm | H01J 35/065 378/122 |
| 2017/0281118 | A1* | 10/2017 | Hirayu | H01J 35/153 |
| 2018/0053618 | A1 | 2/2018 | Fritzler et al. | |
| 2019/0206653 | A1* | 7/2019 | Zou | H01J 35/10 |
| 2020/0023137 | A1* | 1/2020 | Byerly | A61M 5/31551 |

OTHER PUBLICATIONS

German Decision to Grant and English translation thereof dated Oct. 13, 2021.
German Office Action for German Application No. 10 2020 206 939.5 dated Apr. 1, 2021.
German Decision to Grant dated Oct. 13, 2021.

* cited by examiner

X-RAY RADIATOR

PRIORITY STATEMENT

The present application hereby claims priority under 35 U.S.C. § 119 to German patent application number DE 102020206939.5 filed Jun. 3, 2020, the entire contents of which are hereby incorporated herein by reference.

FIELD

Example embodiments of the invention generally relate to an X-ray radiator and an X-ray assembly.

BACKGROUND

Some conventional X-ray radiators, in particular, a conventional rotary piston X-ray radiator have a central electron source for emitting electrons which are directed, via a contactless deflecting device, for example, a quadrupole, in an hourglass-shaped X-ray tube housing, onto an anode. Such a conventional embodiment leads thereto that in the region of a focal spot of the anode, a field-free space forms and the electrons typically impact at a relatively flat angle upon the anode surface. Typically, it follows therefrom that a high proportion of the back-scattered electrons impact directly upon an output window of the X-ray tube housing and generate a high thermal load on the output window. Furthermore, an extrafocal radiation in the X-ray tube is usually increased.

From U.S. Pat. No. 5,550,890 A, there is known an X-ray source with a housing which forms a vacuum housing, the totality of the housing being rotatable about an axis, a portion of the housing being an anode; a device which rotates the housing about the axis; a cathode device which is mounted within the housing for generating electrons and focusing the electrons on an anode region remote from the axis; and a magnetic field device for holding the cathode within the housing. In this prior art, the emission device is not central, but rather is arranged non-centrally opposite the focal spot of the anode. A disadvantage of this embodiment, however, is that such a magnetic field device cannot prevent a certain amount of judder due to the mechanical mounting. Typically, therefore, the cathode device will have a movement which typically manifests itself directly as a focal spot oscillation originating from a mechanical oscillation of the cathode device, whereby a quality of the X-ray radiation is typically reduced.

SUMMARY

At least one embodiment of the invention provides an X-ray radiator and an X-ray assembly in which a mechanical movement of an electron source is corrected.

Advantageous embodiments are disclosed in the claims.

The X-ray radiator according to an embodiment of the invention includes an evacuated X-ray tube housing which is mounted to be rotatable about a rotation axis, the X-ray tube housing having an anode and an electron source, the anode being arranged within the X-ray tube housing non-rotatably relative to the X-ray tube housing and being configured for generating X-ray radiation by way of electrons impacting upon a focal spot of the anode, the electron source being mounted substantially stationary within the X-ray tube housing relative to the rotation axis, characterized in that the electron source has a main emitter and at least one subsidiary emitter for emitting electrons and in that the electron emission of the main emitter and/or of the at least one subsidiary emitter is controllable such that a spatial movement of the focal spot due to a movement of the electron source is reduced.

An X-ray assembly according to an embodiment of the invention comprises the X-ray radiator and an X-ray detector. The X-ray assembly is configured, in particular, for clinical or production-related imaging. The X-ray detector is provided for acquiring the X-ray radiation attenuated through a subject or object. The acquired X-ray radiation can be used for a reconstruction of an image. The X-ray assembly can be, in particular, part of a computed tomography system, a C-arm angiography system, a conventional X-ray system and/or an X-ray radiation-supported material testing system.

An X-ray radiator according to an embodiment of the invention comprises an evacuated X-ray tube housing, rotatably mounted about a rotation axis, including an anode and an electron source, the anode being arranged within the evacuated X-ray tube housing non-rotatably relative to the evacuated X-ray tube housing and configured to generate X-ray radiation via electrons impacting upon a focal spot of the anode, and the electron source being mounted substantially stationary within the evacuated X-ray tube housing relative to the rotation axis, wherein the electron source includes a main emitter to emit electrons, and at least one subsidiary emitter to emit electrons and wherein electron emission of at least one of the main emitter and the at least one subsidiary emitter is controllable such that a spatial movement of the focal spot, due to a movement of the electron source, is reduced.

An X-ray assembly according to an embodiment of the invention comprises:

the X-ray radiator of an embodiment; and an X-ray detector.

BRIEF DESCRIPTION OF THE DRAWINGS

The invention will now be described and explained in greater detail making reference to the example embodiments illustrated in the drawings. In principle, structures and units which remain essentially the same are identified in the following description of the figures with the same reference signs as on the first occurrence of the relevant structure or unit.

In the drawings.

DETAILED DESCRIPTION OF THE EXAMPLE EMBODIMENTS

Figure 1:
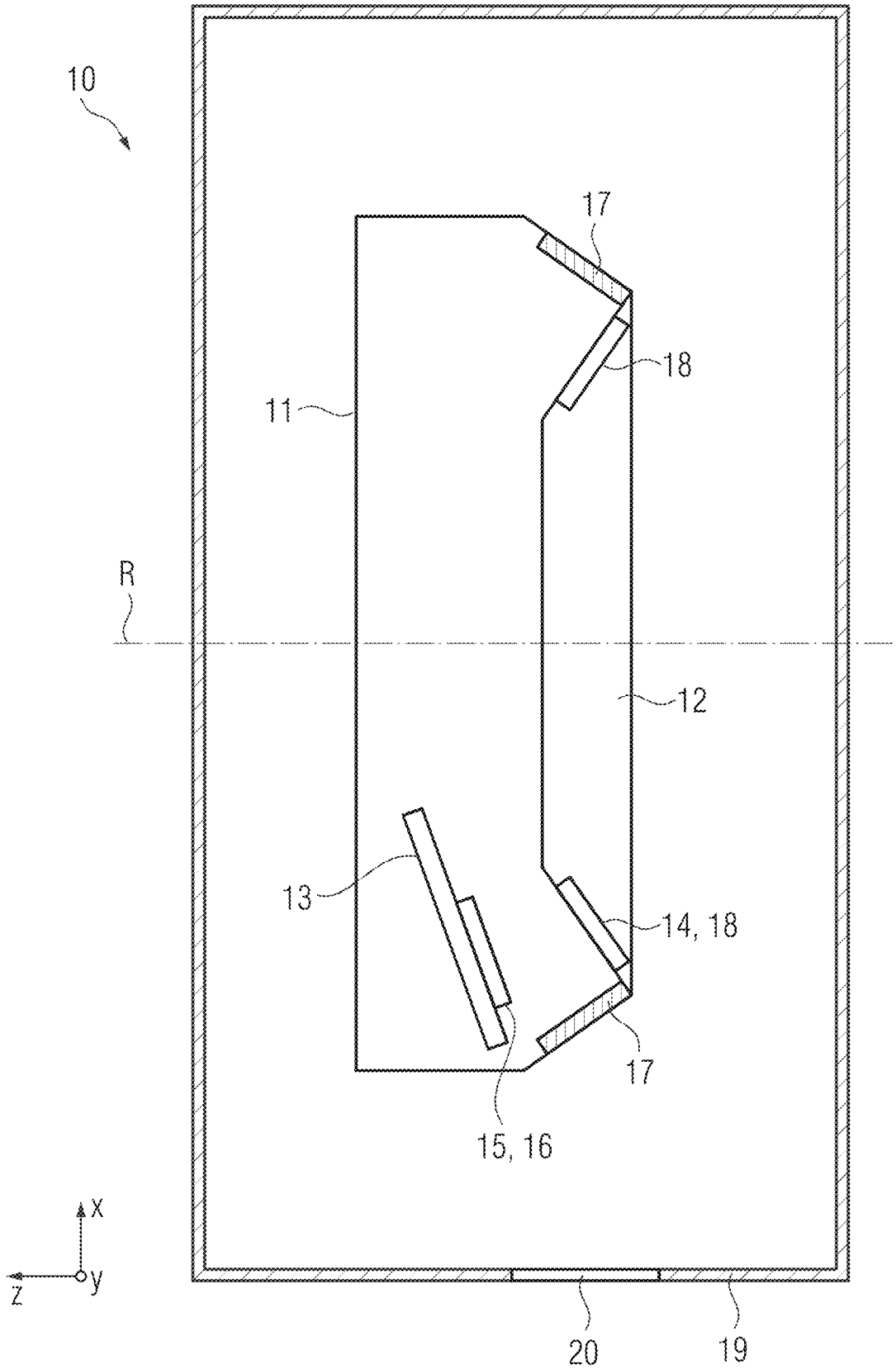
FIG. 1 is an X-ray radiator.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. At least one embodiment of the present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "example" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Units and/or devices according to one or more example embodiments may be implemented using hardware, software, and/or a combination thereof. For example, hardware devices may be implemented using processing circuity such as, but not limited to, a processor, Central Processing Unit (CPU), a controller, an arithmetic logic unit (ALU), a digital signal processor, a microcomputer, a field programmable gate array (FPGA), a System-on-Chip (SoC), a programmable logic unit, a microprocessor, or any other device capable of responding to and executing instructions in a defined manner. Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

In this application, including the definitions below, the term 'module' or the term 'controller' may be replaced with the term 'circuit.' The term 'module' may refer to, be part of, or include processor hardware (shared, dedicated, or group) that executes code and memory hardware (shared, dedicated, or group) that stores code executed by the processor hardware.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

Software may include a computer program, program code, instructions, or some combination thereof, for independently or collectively instructing or configuring a hardware device to operate as desired. The computer program and/or program code may include program or computer-readable instructions, software components, software modules, data files, data structures, and/or the like, capable of being implemented by one or more hardware devices, such as one or more of the hardware devices mentioned above. Examples of program code include both machine code produced by a compiler and higher level program code that is executed using an interpreter.

For example, when a hardware device is a computer processing device (e.g., a processor, Central Processing Unit (CPU), a controller, an arithmetic logic unit (ALU), a digital signal processor, a microcomputer, a microprocessor, etc.), the computer processing device may be configured to carry out program code by performing arithmetical, logical, and input/output operations, according to the program code. Once the program code is loaded into a computer processing device, the computer processing device may be programmed to perform the program code, thereby transforming the computer processing device into a special purpose computer processing device. In a more specific example, when the program code is loaded into a processor, the processor becomes programmed to perform the program code and operations corresponding thereto, thereby transforming the processor into a special purpose processor.

Software and/or data may be embodied permanently or temporarily in any type of machine, component, physical or virtual equipment, or computer storage medium or device, capable of providing instructions or data to, or being interpreted by, a hardware device. The software also may be distributed over network coupled computer systems so that the software is stored and executed in a distributed fashion. In particular, for example, software and data may be stored by one or more computer readable recording mediums, including the tangible or non-transitory computer-readable storage media discussed herein.

Even further, any of the disclosed methods may be embodied in the form of a program or software. The program or software may be stored on a non-transitory computer readable medium and is adapted to perform any one of the aforementioned methods when run on a computer device (a device including a processor). Thus, the non-transitory, tangible computer readable medium, is adapted to store information and is adapted to interact with a data processing facility or computer device to execute the program of any of the above mentioned embodiments and/or to perform the method of any of the above mentioned embodiments.

Example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order.

According to one or more example embodiments, computer processing devices may be described as including various functional units that perform various operations and/or functions to increase the clarity of the description. However, computer processing devices are not intended to be limited to these functional units. For example, in one or more example embodiments, the various operations and/or functions of the functional units may be performed by other ones of the functional units. Further, the computer processing devices may perform the operations and/or functions of the various functional units without sub-dividing the operations and/or functions of the computer processing units into these various functional units.

Units and/or devices according to one or more example embodiments may also include one or more storage devices. The one or more storage devices may be tangible or non-transitory computer-readable storage media, such as random access memory (RAM), read only memory (ROM), a permanent mass storage device (such as a disk drive), solid state (e.g., NAND flash) device, and/or any other like data storage mechanism capable of storing and recording data. The one or more storage devices may be configured to store computer programs, program code, instructions, or some combination thereof, for one or more operating systems and/or for implementing the example embodiments described herein. The computer programs, program code, instructions, or some combination thereof, may also be loaded from a separate computer readable storage medium into the one or more storage devices and/or one or more computer processing devices using a drive mechanism. Such separate computer readable storage medium may include a Universal Serial Bus (USB) flash drive, a memory stick, a Blu-ray/DVD/CD-ROM drive, a memory card, and/or other like computer readable storage media. The computer programs, program code, instructions, or some combination thereof, may be loaded into the one or more storage devices and/or the one or more computer processing devices from a remote data storage device via a network interface, rather than via a local computer readable storage medium. Additionally, the computer programs, program code, instructions, or some combination thereof, may be loaded into the one or more storage devices and/or the one or more processors from a remote computing system that is configured to transfer and/or distribute the computer programs, program code, instructions, or some combination thereof, over a network. The remote computing system may transfer and/or distribute the computer programs, program code, instructions, or some combination thereof, via a wired interface, an air interface, and/or any other like medium.

The one or more hardware devices, the one or more storage devices, and/or the computer programs, program code, instructions, or some combination thereof, may be specially designed and constructed for the purposes of the example embodiments, or they may be known devices that are altered and/or modified for the purposes of example embodiments.

A hardware device, such as a computer processing device, may run an operating system (OS) and one or more software applications that run on the OS. The computer processing device also may access, store, manipulate, process, and create data in response to execution of the software. For simplicity, one or more example embodiments may be exemplified as a computer processing device or processor; however, one skilled in the art will appreciate that a hardware device may include multiple processing elements or processors and multiple types of processing elements or processors. For example, a hardware device may include multiple processors or a processor and a controller. In addition, other processing configurations are possible, such as parallel processors.

The computer programs include processor-executable instructions that are stored on at least one non-transitory computer-readable medium (memory). The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc. As such, the one or more processors may be configured to execute the processor executable instructions.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C #, Objective-C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

Further, at least one embodiment of the invention relates to the non-transitory computer-readable storage medium including electronically readable control information (processor executable instructions) stored thereon, configured in such that when the storage medium is used in a controller of a device, at least one embodiment of the method may be carried out.

The computer readable medium or storage medium may be a built-in medium installed inside a computer device main body or a removable medium arranged so that it can be separated from the computer device main body. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The term code, as used above, may include software, firmware, and/or microcode, and may refer to programs, routines, functions, classes, data structures, and/or objects. Shared processor hardware encompasses a single microprocessor that executes some or all code from multiple modules. Group processor hardware encompasses a microprocessor that, in combination with additional microprocessors, executes some or all code from one or more modules. References to multiple microprocessors encompass multiple microprocessors on discrete dies, multiple microprocessors on a single die, multiple cores of a single microprocessor, multiple threads of a single microprocessor, or a combination of the above.

Shared memory hardware encompasses a single memory device that stores some or all code from multiple modules. Group memory hardware encompasses a memory device that, in combination with other memory devices, stores some or all code from one or more modules.

The term memory hardware is a subset of the term computer-readable medium. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

The X-ray radiator according to an embodiment of the invention includes an evacuated X-ray tube housing which is mounted to be rotatable about a rotation axis, the X-ray tube housing having an anode and an electron source, the anode being arranged within the X-ray tube housing non-rotatably relative to the X-ray tube housing and being configured for generating X-ray radiation by way of electrons impacting upon a focal spot of the anode, the electron source being mounted substantially stationary within the X-ray tube housing relative to the rotation axis, characterized in that the electron source has a main emitter and at least one subsidiary emitter for emitting electrons and in that the electron emission of the main emitter and/or of the at least one subsidiary emitter is controllable such that a spatial movement of the focal spot due to a movement of the electron source is reduced.

The X-ray radiator is advantageous, in particular, since the reduction of the spatial movement of the focal spot advantageously compensates for the movement of the electron source. Due to the reduction in the spatial movement of the focal spot, in particular, the X-ray radiation generated in the focal spot is judder free. Advantageously thereby, a quality of the X-ray radiation can be enhanced. Typically, the quality of the X-ray radiation correlates with an image quality.

The rotation axis of the X-ray radiator is, in particular, a spin axis. The rotation axis of the X-ray radiator is, in particular, the rotation axis of the X-ray tube housing.

Typically, the X-ray radiator has an X-ray radiator housing in which the X-ray tube housing is arranged. The X-ray radiator housing can have a stationary X-ray radiator output window and/or can have a liquid or gaseous coolant. The X-ray radiator is preferably configured for a clinical or production-related imaging. The clinical imaging comprises, in particular, a medical imaging. The production-related imaging comprises, in particular, a material testing.

The evacuated X-ray tube housing comprises, in particular, an inner space, preferably having a hard vacuum. Within the evacuated X-ray tube housing, the emitted electrons are typically accelerated from the electron source toward the anode. A typical acceleration voltage is in the range between 40 and 150 kV. The X-ray tube housing typically has metal and/or glass.

The anode is typically rotationally symmetrical relative to the rotation axis and/or includes tungsten, gold and/or molybdenum. The anode can, in principle, be connected to a cooling body. The cooling body can be configured, for example, as part of the X-ray tube housing. The cooling body can form a rear side of the anode, while the electrons impact upon the front side of the anode. The cooling body is coolable, for example, via the coolant of the X-ray radiator housing. The cooling body can be cooled, for example, in that a heat exchange takes place on a surface of the cooling body, in particular, on the basis of the rotation of the X-ray radiator housing. The electrons typically impact upon the anode during operation of the X-ray radiator. The impacting electrons typically interact with the anode such that the X-ray radiation is generated. The X-ray radiation is typically generated in the focal spot. The focal spot is typically a portion of a rotationally symmetrical focus path on the anode and/or is decentralized relative to the rotation axis. Decentralized means, in particular, removed at a radius or distance of greater than 0 from the reference point, for example, the rotation axis. The focal spot is typically temporally variable and/or positionally variable in relation to the focus path which is rotatable during operation. The anode is arranged non-rotatably within the X-ray tube housing, for example, via a fastening device, in particular, a bolt and/or a solder point. The anode typically rotates with the X-ray tube housing. The anode and the X-ray tube housing can form, in particular, a structurally firmly connected unit with one another.

The electron source is arranged, in particular, relative to the focal spot such that the emitted electrons preferably impact on the focal spot without a deflection unit. The electron source is mounted within the X-ray tube housing, in particular, substantially stationary relative to the X-ray radiator housing. The electron source is mounted within the X-ray tube housing relative to the rotation axis and/or to the X-ray radiator housing such that the electron source is not rotated relative to the X-ray radiator housing with the anode and the X-ray tube housing during the operation of the X-ray radiator. Rotation with the anode and the X-ray tube housing is counteracted, for example, by a fixation unit. The fixation unit is, in particular, a magnetic fixation unit. The electron source is mounted within the X-ray tube housing, substantially stationary relative to the rotation axis contrary to the X-ray tube housing which rotates during operation, for example, via the fixation unit. On the basis of the arrangement of the electron source within the X-ray tube housing which is rotatably mounted and rotates during operation, the electron source is preferably decoupled from the rotation of the X-ray tube housing. For example, the electron source is mounted rotatable relative to the rotating X-ray tube housing such that the electron source is substantially stationary relative to the rotation axis, whereby the electron source is preferably decoupled from the rotation of the X-ray tube housing. The rotatable mounting can include the electron source having a central mounting relative to the rotation axis and the main emitter and the at least one subsidiary emitter being arranged decentrally relative to the rotation axis, in particular, spatially in relation to the focal spot which is decentralized relative to the rotation axis.

The electron source, in particular, the main emitter and the at least one subsidiary emitter, are typically configured so that the electrons are emitted in anticipation of a geometry, a position and/or an intensity of the focal spot. The electrons are emitted, in particular, focused and/or directed, preferably as defined for the focal spot. Advantageously, therefore, no deflecting or focusing unit is provided in the X-ray radiator therefor. The X-ray radiator is typically configured such that the main emitter is typically operated for longer than the at least one subsidiary emitter. For example, the main emitter can be arranged directly opposite the focal spot, while the subsidiary emitter is arranged beside the main emitter, in particular, in the phi, z or r-direction in relation to the rotation axis. A distance between the main emitter and the at least one subsidiary emitter is preferably 0. Alternatively, the main emitter and the at least one subsidiary emitter advantageously adjoin one another.

The electron emission of the main emitter and/or the at least one subsidiary emitter is, in particular, controllable via a constructional embodiment of the X-ray radiator, in particular, the electron source. The constructional embodiment comprises, in particular, a hardware control system, preferably without software control. The constructional embodiment of the X-ray radiator typically takes place during an assembly and/or production of the X-ray radiator, however before a clinical or production-related use of the X-ray radiator. The constructional embodiment can comprise, in particular, an electric circuit and/or an arrangement of electrically and/or electromagnetically interacting units of the X-ray radiator relative to one another, in particular, the electron source to the X-ray radiator housing. The electron emission of the main emitter and/or of the at least one subsidiary emitter typically takes place dependent upon a control signal coming from the constructional embodiment. The constructional embodiment can trigger the control signal in a threshold value-based or binary manner and/or without feedback of the actually emitted X-ray radiation during operation of the X-ray radiator. The binary triggering depends, for example, on whether a particular electrical contact is made in the electric circuit or not. The threshold value-based triggering depends, in particular, on how strong the electromagnetic interactions of the units of the X-ray radiator to one another are. The electric circuit is, in particular, non-solid state. The electromagnetic interaction is, in particular, contactless.

The embodiments described below of the sliding connection and the proximity sensor serve, in particular, as examples for a variant with an electrical circuit and/or a variant with an electromagnetic interaction.

The controllability of the electron emissions of the main emitter and/or of the at least one subsidiary emitter comprises, in particular, an individual switching, for example, switching on or off, of the main emitter or the at least one subsidiary emitter, in particular, dependent upon the control signal. The switching on can take place step-wise in order to be able to regulate the intensity of the electron current. The individual switching comprises, in particular, the switching on or switching off of the at least one subsidiary emitter at a time point at which the main emitter is switched on. The individual switching alternatively or additionally comprises, in particular, the switching on or switching off of the main emitter at a further time point at which the at least one subsidiary emitter is switched on.

During operation of the X-ray radiator, the X-ray tube housing typically rotates, while in particular, the X-ray radiator housing is stationary and the electron source is substantially stationary. That the electron source is substantially stationary means, in particular, that the electron source has a typically constructionally and/or mechanically-caused movement during the operation of the X-ray radiator. The constructionally and/or mechanically-caused movement can be a wobble, a vibration and/or an inertial movement and/or occurs typically during the operation of the X-ray radiator. The movement of the electron source occurring during the operation of the X-ray radiator is typically unwanted. The spatial movement of the focal spot and/or of the electron source is possible, in particular, in all spatial directions. The constructionally and/or mechanically-caused movement of the electron source during the operation of the X-ray radiator is conventionally transferred to the focal spot. The spatial movement of the focal spot is due, in particular, to the movement of the electron source because the focal spot typically depends directly upon the geometry, the position and/or the intensity of the electrons emitted by the electron source. The X-ray radiation, in particular, the quality of the X-ray radiation typically depends directly upon the geometry, the position and/or the intensity of the focal spot.

The electron source is preferably mounted within the X-ray tube housing substantially stationary relative to the rotation axis despite the typically constructionally and/or mechanically-caused movement during the operation of the X-ray radiator. The controllability of the electron emission advantageously enables the spatial movement of the focal spot due to the movement of the electron source to be reduced. The electron emission of the main emitter and/or of the at least one subsidiary emitter is preferably controllable such that the spatial movement of the focal spot due to the movement, in particular the wobbling, the vibration and/or the inertial movement of the electron source is reduced. The electron emission is controllable, in particular, such that the electrons are emitted against the movement, in particular the wobbling, the vibration and/or the inertial movement of the electron source. In particular, the main emitter and/or the at least one subsidiary emitter are configured such that the electrons are emitted against the movement, in particular the wobbling, the vibration and/or the inertial movement of the electron source. The electron emission counteracts, in particular, the movement of the electron source, preferably the electron emission at least partially compensates for the movement of the electron source, wherein the spatial movement of the focal spot is reduced. The reduction corresponds, in particular, to an at least partial compensation. Through the reduction of the movement of the focal spot, the focal spot is preferably stabilized.

One embodiment provides that the main emitter and/or the subsidiary emitter is a filament emitter, a flat emitter and/or a field-effect emitter. This embodiment is advantageous, in particular, since different types of emitters are combined. The electron emission of the field-effect emitter is, in general, typically switchable on or off more rapidly as compared with a filament emitter and/or a flat emitter. The field-effect emitter is therefore advantageous for the rapid reduction of the spatial movement of the focal spot. Depending upon the embodiment of the respective emitter, an operating duration and/or an electron current density of the filament emitter and/or of the flat emitter can be greater than with a field-effect emitter.

One embodiment provides that the main emitter is a filament emitter or a flat emitter and the subsidiary emitter is a field-effect emitter. This embodiment is advantageous, in particular, since the comparatively high switching speed of the field-effect emitter is combined with the comparatively high operating duration and/or electron current density of the filament emitter and/or the flat emitter.

One embodiment provides that the electron source has a segmented field-effect emitter, a first segment of the segmented field-effect emitter forming the main emitter and a second segment of the segmented field-effect emitter forming the at least one subsidiary emitter. The field-effect emitter is typically constructed on the basis of silicon or carbon. A silicon field-effect emitter advantageously has a comparatively or higher operating duration and/or electron current density than the filament emitter and/or the flat emitter. The field-effect emitter typically has a plurality of field-effect emitter needles for the emission of the electrons. It is conceivable, in principle, that each segment of the segmented field-effect emitter has only one single field-effect emitter needle. Typically, the first segment and/or the second segment of the segmented field-effect emitter has at least so many field-effect emitter needles that the operation of the X-ray radiator can take place with an electron current density of greater than or equal to 0.1 A/cm^2, preferably greater than or equal to 1 A/cm^2, particularly advantageously greater than or equal to 10 A/cm^2 over an operating duration of at least 1 h, preferably 100 h, particularly advantageously 10000 h. The segmented field-effect emitter can be a sealed modular unit which is mountable, for example, as a whole on the electron source. The segmentation of the segmented field-effect emitter can be configured according to a Cartesian or a polar coordinate system. The segmentation of the segmented field-effect emitter can take place via a physical, for example, an electrically irreversible, connection of the field-effect emitter or via a logical connection, preferably changeable during the operating duration of the field-effect emitter. The field-effect emitter can have, for example, two layers, a first layer having the field-effect emitter needles and a second layer having the physical or logical connection, wherein the connection defines the segmentation. An extent and/or a number of field-effect emitter needles of the first segment can differ from an extent and/or a number of field-effect emitter needles of the second segment. Typically, the main emitter has more field-effect emitter needles than the at least one subsidiary emitter.

One embodiment provides that the electron source has a further subsidiary emitter in addition to the main emitter and the at least one subsidiary emitter, the further subsidiary emitter being arranged offset orthogonally to the main emitter and the at least one subsidiary emitter. Typically, the further emitter and the at least one subsidiary emitter are of the same type, for example, a field-effect emitter. This embodiment is advantageous, in particular, because the spatial movement of the focal spot can be reduced through the controllability of the electron emission in more than one direction, for example, in two of the three directions phi, z, r in relation to the rotation axis. This embodiment is particularly advantageous in combination with the previous embodiment in which the electron source has the segmented field-effect emitter, the first segment of the segmented field-effect emitter forming the main emitter and the second segment of the segmented field-effect emitter forming the at least one subsidiary emitter.

One embodiment provides that the X-ray radiator further has a proximity sensor, the electron emission of the main emitter and/or of the at least one subsidiary emitter preferably being controllable dependent upon a control signal of the proximity sensor such that the spatial movement of the focal spot due to the movement of the electron source is reduced. The proximity sensor can provide, in particular, a threshold value-based control signal for controlling the electron emission of the main emitter and of the at least one subsidiary emitter. An advantage of this embodiment is, in particular, that the electron emission is contactlessly controllable.

One embodiment provides that the X-ray radiator further has a sliding connection between a stationary first sliding contact and a second sliding contact arranged on the electron source, the electron emission of the main emitter and/or of the at least one subsidiary emitter being controllable dependent upon a contacting of the sliding connection such that the spatial movement of the focal spot due to the movement of the electron source is reduced. The sliding contact can take place, in particular, via a slideway and a sliding head, in particular a sliding brush. The sliding connection can advantageously provide a binary control signal for controlling the electron emission of the main emitter and of the at least one subsidiary emitter. In comparison with the previous threshold value-based embodiment, the sliding connection, in particular, offers an advantage because the control signal is simpler.

One embodiment provides that the electron source within the X-ray tube housing is mounted substantially stationary relative to the rotation axis via a contactless fixation unit. This embodiment is advantageous, in particular, because the fixation unit can act contactlessly through the X-ray tube housing. The contactless, in particular, magnetic fixation unit has at least one stationary fixation provider, for example, a magnet, and fixation receiver which is movable relative to the fixation provider, for example, a further magnet. The fixation provider is arranged, for example, stationary in the X-ray radiator housing. The fixation receiver is typically arranged on the electron source, in particular, at least rigidly connected to the electron source. It is conceivable that the fixation receiver is arranged in the central or decentralized region of the electron source. The fixation receiver can typically at least not completely prevent or compensate for the movement of the focal spot, in particular, the wobbling, the vibration and/or the inertial movement, so that the electron source is typically only substantially stationary.

An X-ray assembly according to an embodiment of the invention comprises the X-ray radiator and an X-ray detector. The X-ray assembly is configured, in particular, for clinical or production-related imaging. The X-ray detector is provided for acquiring the X-ray radiation attenuated through a subject or object. The acquired X-ray radiation can be used for a reconstruction of an image. The X-ray assembly can be, in particular, part of a computed tomography system, a C-arm angiography system, a conventional X-ray system and/or an X-ray radiation-supported material testing system.

FIG. 1 shows a cross-section through an X-ray radiator 10 along a rotation axis R. The rotation axis R is parallel to the z-axis. The X-ray radiator 10 has an evacuated X-ray tube housing 11 mounted to be rotatable about the rotation axis R, and an X-ray radiator housing 19. The X-ray tube housing 11 has an anode 12 and an electron source 13. The anode 12 is configured with an attenuated cone shape. The anode 12 is arranged within the X-ray tube housing 11 to be non-rotatable relative to the X-ray tube housing 11. The anode 12 forms at least a part of a cover of the X-ray tube housing 11 which is at least partially cylindrical. The anode 12 is configured for generating X-ray radiation via electrons impacting upon a focal spot 14 of the anode 12. The focal spot 14 is part of a focus path 18. The X-ray tube housing 11 has an annular X-ray tube output window 17 in the region of the anode 12. The X-ray radiator housing 19 has a stationary X-ray radiator output window 20 in the region of the focal spot 14. The electron source 13 is mounted within the X-ray tube housing 11 substantially stationary relative to the rotation axis R. During operation of the X-ray radiator 10, the X-ray tube housing 11 rotates within the X-ray radiator housing 19 about the rotation axis R. The electron source 13 has a main emitter 15 and at least one subsidiary emitter 16 for emitting electrons. The electron source 13 is arranged decentrally removed at a spacing of greater than 0 from the rotation axis R relative to the focal spot 14. The electrons impact steeply upon the focal spot.

On the basis of the rotation of the X-ray tube housing 11, during operation, a wobbling, a vibration or an inertial movement can act upon the electron source 13, by which it is moved. By this, conventionally, the focal spot 14 is directly affected, for example, also moved. The electron emission of the main emitter 15 and/or of the at least one subsidiary emitter 16 is controllable such that the spatial movement of the focal spot 14 due to the movement of the electron source 13 is reduced.

Figure 2:
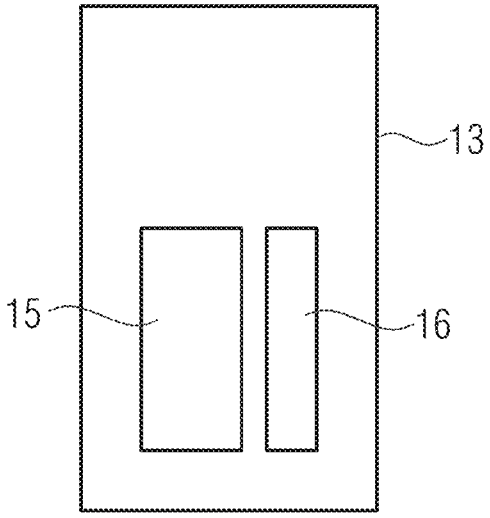
FIG. 2 is a main emitter and at least one subsidiary emitter.

FIG. 2 shows a plan view of the main emitter 15 and the at least one subsidiary emitter 16. The main emitter 15 and/or the at least one subsidiary emitter 16 is a filament emitter, a flat emitter and/or a field-effect emitter. In a further alternative embodiment, the main emitter 15 is a filament emitter or a flat emitter and the at least one subsidiary emitter 16 is a field-effect emitter.

Figure 3:
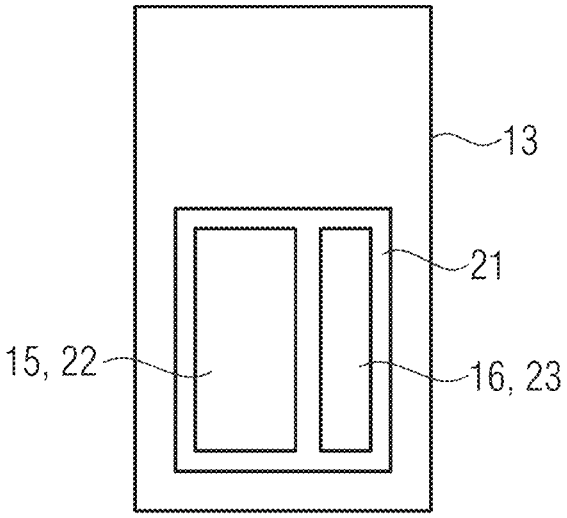
FIG. 3 is a segmented field-effect emitter.

FIG. 3 shows a plan view of a segmented field-effect emitter 21. The electron source 13 has the segmented field-effect emitter 21. A first segment 22 of the segmented field-effect emitter 21 forms the main emitter 15. A second segment 23 of the segmented field-effect emitter 21 forms the at least one subsidiary emitter 16. The segmentation of the segmented field-effect emitter 21 is configured according to a Cartesian coordinate system.

In an alternative embodiment (not shown) the segmentation of the segmented field-effect emitter 21 is configured according to a polar coordinate system. In this case, the first segment 22 is, for example, annular and the second segment 23 is circular segment-shaped.

Figure 4A:
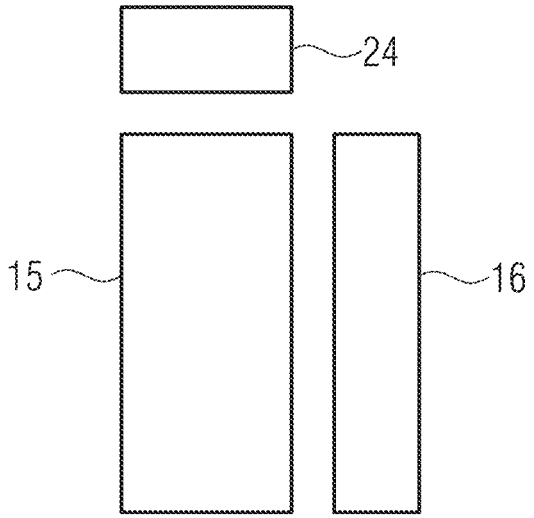
FIGS. 4A and 4B is a further emitter arrangement.
Figure 4B:
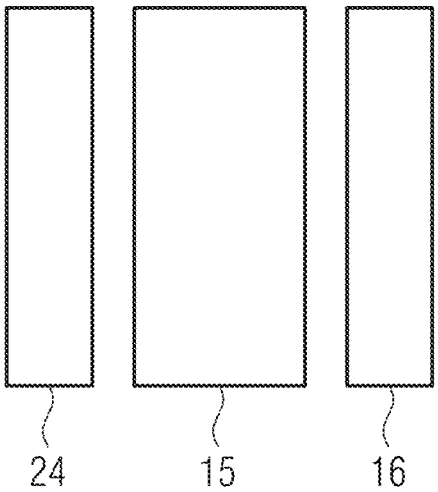

FIGS. 4A and 4B show an advantageous development of the emitter arrangements shown in FIGS. 2 and 3, the example embodiments of FIG. 4A and FIG. 4B being expressly compatible with one another and combinable. The electron source 13 has a further subsidiary emitter 24 in addition to the main emitter 15 and the at least one subsidiary emitter 16. In FIG. 4A, the further subsidiary emitter 24 in addition to the main emitter 15 and the at least one subsidiary emitter 16 is arranged orthogonally offset. In FIG. 4B, the main emitter 15 is arranged between the further subsidiary emitter 24 and the at least one subsidiary emitter 16.

Figure 5:
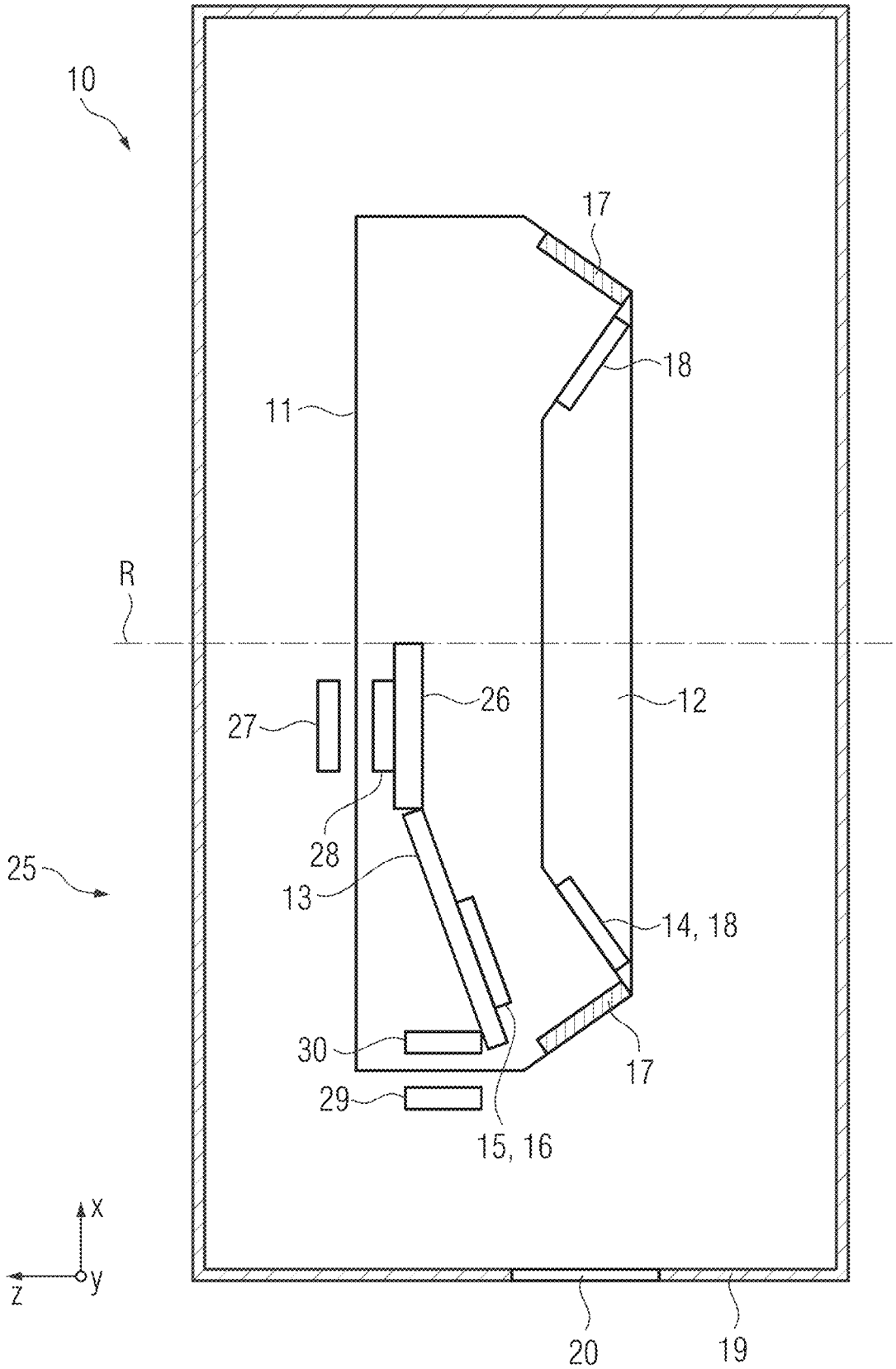
FIG. 5 is the X-ray radiator in a further embodiment.

FIG. 5 shows a development of the example embodiment shown in FIG. 1. The electron source 13 is mounted within the X-ray tube housing 11 substantially stationary relative to the rotation axis R via a contactless fixation unit 25. In the region of the contactless fixation unit 25, the X-ray tube housing 11 is permeable to electromagnetic fields. The electron source 13 is suspended or mounted via a cathode holder 26 substantially stationary on the rotation axis R. The contactless fixation unit 25 has a fixation provider 27 and a fixation receiver 28. The fixation provider 27 and the fixation receiver 28 are magnetic and are configured such that the electron source 13 is mounted within the X-ray tube housing 11 substantially stationary relative to the rotation axis R. In this example embodiment, the contactless fixation unit 25 additionally and optionally has a further fixation provider 29 and a further fixation receiver 30. The further fixation provider 29 and the further fixation receiver 30 as well as the fixation provider 27 and the fixation receiver 28 can, paired individually or in combination, hold and/or mount the electron source 13 within the X-ray tube housing 11 substantially stationary relative to the rotation axis R.

Figure 6:
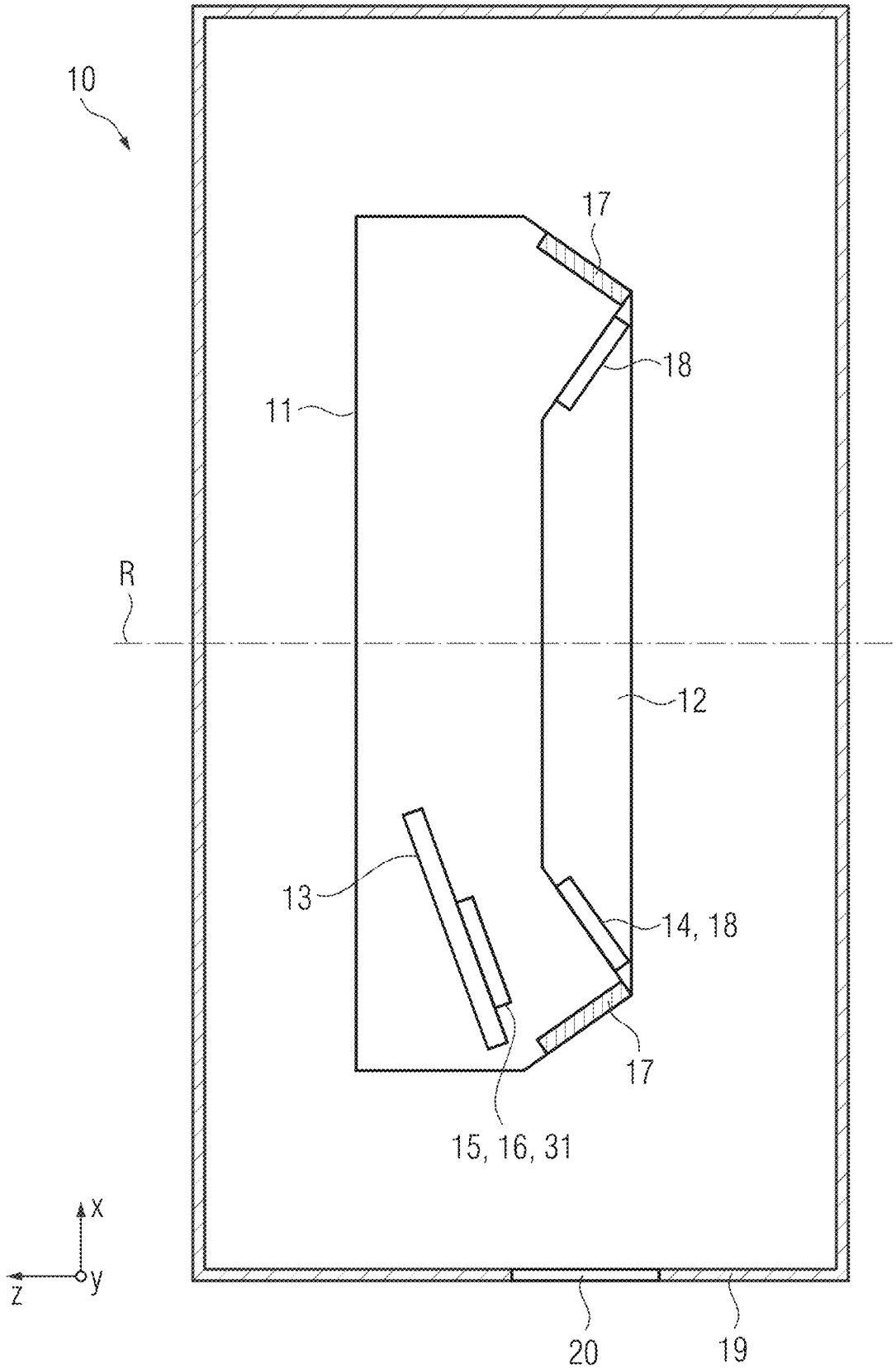
FIG. 6 is the X-ray radiator in an additional embodiment.

FIG. 6 shows a further example embodiment. The X-ray radiator 10 further has a proximity sensor 31. The electron emission of the main emitter 15 and/or of the at least one subsidiary emitter 16 is controllable dependent upon a control signal of the proximity sensor 31 such that the spatial movement of the focal spot 14 due to the movement of the electron source 13 is reduced. The proximity sensor 31 typically has a first sensor for the main emitter 15 and a second sensor for the at least one subsidiary emitter 16. The proximity sensor 31, in particular, the first sensor and the second sensor is configured such that, dependent upon a distance of the first sensor or the second sensor from a stationary reference point outside the X-ray tube housing 11, the control signal can be triggered. In this example embodiment, the stationary reference point is the X-ray radiator output window 20. Alternatively or additionally, the stationary reference point can be a magnet arranged stationary on the X-ray radiator housing 19. If the first sensor has a distance of less than a threshold value between the main emitter 15 and the stationary reference point, the control signal is triggered for the main emitter 15, which switches on. If the second sensor ascertains a distance of less than a threshold value between the at least one subsidiary emitter 16 and the stationary reference point, the control signal is triggered for the at least one subsidiary emitter 16, which switches on. By this, the movement of the focal spot can be reduced.

Although the invention has been illustrated and described in detail with the preferred example embodiments, the invention is not restricted by the examples given and other variations can be derived therefrom by a person skilled in the art without departing from the protective scope of the invention.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An X-ray radiator, comprising:

an evacuated X-ray tube housing rotatably mounted about a rotation axis, the evacuate X-ray tube housing including an anode and an electron source, the anode being arranged within the evacuated X-ray tube housing non-rotatably relative to the evacuated X-ray tube housing, and the anode being configured to generate X-ray radiation via electrons impacting a focal spot of the anode, and the electron source being mounted substantially stationary within the evacuated X-ray tube housing relative to the rotation axis, wherein the electron source includes a main emitter, and at least one subsidiary emitter to emit electrons, and wherein an electron emission of at least one of the main emitter or the at least one subsidiary emitter is controllable to reduce a spatial movement of the focal spot due to a movement of the electron source, the spatial movement of the focal spot being reduced without use of a deflection unit to deflect the electrons of the electron emission.

2. The X-ray radiator of claim 1, wherein at least one of the main emitter or the at least one subsidiary emitter is at least one of a filament emitter, a flat emitter or a field-effect emitter.

3. The X-ray radiator of claim 2, wherein the main emitter is a filament emitter or a flat emitter and the at least one subsidiary emitter is a field-effect emitter.

4. The X-ray radiator of claim 1, wherein the electron source includes a segmented field-effect emitter, the segmented field-effect emitter including a first segment forming the main emitter and a second segment forming at least one subsidiary emitter.

5. The X-ray radiator of claim 2, wherein the electron source includes a segmented field-effect emitter, the segmented field-effect emitter including a first segment forming the main emitter and a second segment forming the at least one subsidiary emitter.

6. The X-ray radiator of claim 1, wherein the electron source includes a further subsidiary emitter, the further subsidiary emitter being arranged offset orthogonally relative to the main emitter and to the at least one subsidiary emitter.

7. The X-ray radiator of claim 6, wherein the electron source includes a segmented field-effect emitter, the segmented field-effect emitter including a first segment forming the main emitter, a second segment forming the at least one subsidiary emitter, and a third segment forming the further subsidiary emitter.

8. The X-ray radiator of claim 1, further comprising:

a proximity sensor, wherein controlling of the electron emission of the least one of the main emitter or the at least one subsidiary emitter is dependent upon a control signal of the proximity sensor.

9. The X-ray radiator of claim 2, further comprising:

a proximity sensor, wherein controlling of the electron emission of the at least one of the main emitter or the at least one subsidiary emitter is dependent upon a control signal of the proximity sensor.

10. The X-ray radiator of claim 3, further comprising:

a proximity sensor, wherein controlling of the electron emission of the at least one of the main emitter or the at least one subsidiary emitter is dependent upon a control signal of the proximity sensor.

11. The X-ray radiator of claim 1, wherein the electron source is mounted within the evacuated X-ray tube housing substantially stationary relative to the rotation axis via a contactless fixation device.

12. The X-ray radiator of claim 2, wherein the electron source is mounted within the evacuated X-ray tube housing substantially stationary relative to the rotation axis via a contactless fixation device.

13. The X-ray radiator of claim 3, wherein the electron source is mounted within the evacuated X-ray tube housing substantially stationary relative to the rotation axis via a contactless fixation device.

14. An X-ray assembly, the X-ray assembly comprising:

the X-ray radiator of claim 1; and an X-ray detector.

* * * * *